US006958667B2

(12) United States Patent
Mizoguchi et al.

(10) Patent No.: US 6,958,667 B2
(45) Date of Patent: Oct. 25, 2005

(54) ELECTRONIC CHIP COMPONENT

(75) Inventors: Naoki Mizoguchi, Moriyama (JP); Hisatake Okamura, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/780,400

(22) Filed: Feb. 17, 2004

(65) Prior Publication Data

US 2004/0183629 A1 Sep. 23, 2004

(30) Foreign Application Priority Data

Mar. 18, 2003 (JP) ..... 2003-074288
Nov. 28, 2003 (JP) ..... 2003-398894

(51) Int. Cl.[7] ..... H01P 1/203; H01P 7/08
(52) U.S. Cl. ..... 333/204; 333/219
(58) Field of Search ..... 333/204, 202, 333/219, 246

(56) References Cited

U.S. PATENT DOCUMENTS 2,922,968 A 1/1960 Van Patten
5,818,313 A * 10/1998 Estes et al. ..... 333/202
5,834,994 A * 11/1998 Shapiro ..... 333/202
5,977,850 A * 11/1999 Chaturvedi ..... 333/238
2002/0053960 A1 * 5/2002 Kanba et al. ..... 333/204

FOREIGN PATENT DOCUMENTS

JP 2000-208670 7/2000
JP 2002-237610 8/2001
JP 2002280806 A * 9/2002 ..... H01P 1/203
JP 2002-325002 11/2002
JP 2002335111 A * 11/2002 ..... H01P 11/00
JP 2002-368503 12/2002

* cited by examiner

*Primary Examiner*—Seungsook Ham
(74) *Attorney, Agent, or Firm*—Keating & Bennett, LLP

(57) ABSTRACT

A band-pass filter functioning as a electronic chip component includes a chip having upper and lower surfaces, a pair of side surfaces, and first and second end surfaces facing each other. A resonator electrode is disposed in the chip. The band-pass filter also includes input and output electrodes extending in the vertical direction, which are coupled or connected to the resonator electrode, and a tubular first ground electrode surrounding the chip so as to enclose the resonator electrode. The input and output electrodes are disposed at end portions or inner sides of the tubular portion so as not to be electrically connected to the first ground electrode. The band-pass filter further includes two pairs of second ground electrodes which are disposed on both sides of the input electrode and/or output electrode and which are electrically connected to the first ground electrode.

8 Claims, 16 Drawing Sheets

ELECTRONIC CHIP COMPONENT

BACKGROUND OF THE INVENTION

1. Field of the Invention

The present invention relates to electronic chip components used as chip resonant elements and band-pass filters. More specifically, the present invention relates to a electronic chip component including a chip provided with a resonator electrode and input and output electrodes connected or coupled to the resonator electrode.

2. Description of the Related Art

Various types of band-pass filters used in high-frequency regions, such as dual-mode band-pass filters and band-pass filters using a wavelength resonator, have been proposed.

For example, Patent Document 1, Japanese Unexamined Patent Application Publication No. 2001-237610, discloses a dual-mode band-pass filter using a resonator electrode including a through hole. As shown in the cross-sectional view and a schematic plan view in FIGS. 15A and 15B, a dual-mode band-pass filter 101 includes a dielectric substrate 102. A resonator electrode 103 is disposed at the center in a height direction of the dielectric substrate 102. The resonator electrode 103 includes a through hole 103*a*. The resonator electrode 103 generates a plurality of resonance modes which are not degraded. The through hole 103*a* couples the resonance modes, such that the dual-mode band-pass filter is obtained.

Ground electrodes 104 and 105, which face the resonator electrode 103, are disposed on the upper and lower surfaces of the dielectric substrate 102. Also, as shown in FIG. 15B, input/output coupled electrodes 106 and 107 are coupled to the resonator electrode 103. Although not shown in FIG. 15A, the input/output coupled electrodes 106 and 107 extend outward from the vicinity of the resonator electrode 103 and are electrically connected to input/output electrodes (not shown).

In a chip-shaped band-pass filter in which ground electrodes are disposed over and under a resonator electrode via dielectric substrate layers, such as the dual-mode band-pass filter 101, or in a band-pass filter in which a ground electrode covers four surfaces of a substrate, the ground electrode is usually also provided on side surfaces of the dielectric substrate. Therefore, the ground electrodes define a waveguide. In other words, the resonator electrode 103 is in the waveguide. With this configuration, resonance is generated depending only on the shape of the waveguide. On the other hand, the above-described waveguide portion defined by the ground electrodes is inevitably larger than the resonator electrode 103.

With this configuration, a basic-mode resonance caused by the ground electrodes is generated at the side of a frequency lower than the resonance frequency of the resonator electrode 103, and higher modes thereof tend to be generated one after another at the portion overlapping the resonance mode of the resonator electrode 103. The resonance caused by the ground electrodes generates undesired spurious signals in the dual-mode band-pass filter 101, and thus a favorable transmission characteristic is not obtained.

SUMMARY OF THE INVENTION

To overcome the problems described above, preferred embodiments of the present invention provide a band-pass filter that suppresses undesired spurious signals based on resonance caused by a ground electrode and that has a favorable transmission characteristic.

The electronic chip component according to a preferred embodiment of the present invention includes a chip having upper and lower surfaces, a pair of side surfaces, and first and second end surfaces facing each other, a resonator electrode in the chip, input and output electrodes extending in the vertical direction, which are coupled or connected to the resonator electrode, and a first ground electrode around the chip, the first ground electrode having a tubular shape so as to enclose the resonator electrode. The input and output electrodes are disposed at end portions or inner sides of the tubular first ground electrode, such that the input and output electrodes are not electrically connected to the first ground electrode. The electronic chip component further includes at least a pair of second ground electrodes which are disposed on both sides of the input electrode and/or the output electrode and which are electrically connected to the first ground electrode. With this configuration, undesired spurious signals due to the shape of the first ground electrode are effectively suppressed and favorable resonance/transmission characteristics are obtained.

The chip is preferably substantially rectangular, the input and output electrodes are preferably disposed on the first and second end surfaces facing each other, respectively, and the first ground electrode preferably includes surfaces that are substantially parallel with the upper and lower surfaces and the pair of side surfaces of the chip so as to have a tubular shape.

At least one of the surfaces of the first ground electrode that is substantially parallel with the upper and lower surfaces and the pair of side surfaces of the chip may is preferably embedded in the chip. With this configuration, at an outer surface of the chip in the side in which portion of the first ground electrode is embedded, short circuit caused by another electronic component is prevented.

The first ground electrode preferably surrounds the upper and lower surfaces and the pair of side surfaces of the chip. In that case, the first ground electrode is easily formed by providing a conductive film on the outer surface of the chip.

The input and output electrodes may extend in the vertical direction on the first and second end surfaces, respectively. In that case, the input and output electrodes can be easily formed by applying conductive films on the end surfaces.

The input and output electrodes preferably include via-hole electrodes which extend in the vertical direction in the chip and which are led to the upper or lower surface of the chip so as not to be electrically connected to the first ground electrode. In that case, the entire outer surface of the chip except a region to which the input and output electrodes are led is covered by the first ground electrode, so as to enhance an electromagnetic shielding characteristic. Also, packaging space in the electronic chip component is saved.

The second ground electrodes preferably extend in the vertical direction at the end surfaces of the chip. In that case, the portion of the second ground electrodes on the end surfaces of the chip is easily formed by applying conductive films on the end surfaces.

The second ground electrodes preferably extend in the vertical direction in the chip and are electrically connected to the first ground electrode at the upper surface and/or the lower surface of the chip. In that case, the second ground electrodes are formed by using via-hole electrodes. Therefore, the positions of the second ground electrodes are precisely adjusted so as to suppress undesired spurious signals more effectively.

The resonator electrode is preferably configured so as to generate a plurality of resonance modes which are not degraded and the resonator electrode preferably includes a through hole for coupling the plurality of resonance modes, whereby a band-pass filter is obtained. With this configuration, a band-pass filter having a favorable transmission characteristic is obtained according to preferred embodiments of the present invention.

The electronic chip component preferably further includes a third ground electrode which extends in the through hole so as not to be in contact with the resonator electrode and which is electrically connected to the first ground electrode. With this configuration, the third ground electrode further suppresses undesired spurious signals.

The resonator electrode may be a ring-shaped resonator. By using the ring-shaped resonator, a dual-mode band-pass filter generating reduced undesired spurious signals is provided according to preferred embodiments of the present invention.

Other features, elements, characteristics, steps and advantages of the present invention will become more apparent from the following detailed description of preferred embodiments with reference to the attached drawings.

DETAILED DESCRIPTION OF PREFERRED EMBODIMENTS

Figure 1A:
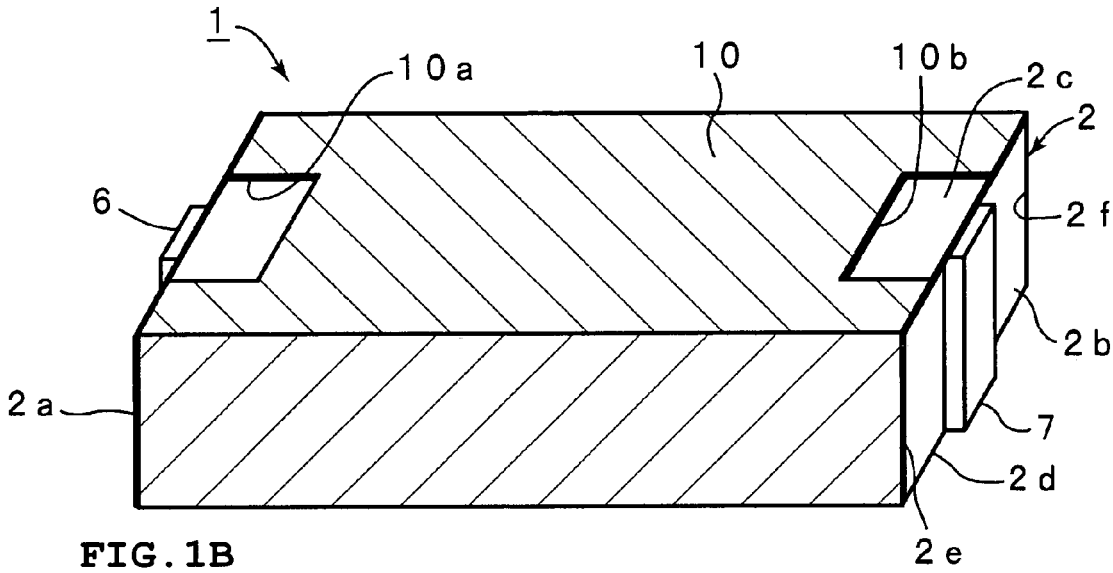
FIGS. 1A and 1B are a perspective view and a schematic plan view showing a dual-mode band-pass filter according to a first preferred embodiment of the present invention.
Figure 1B:
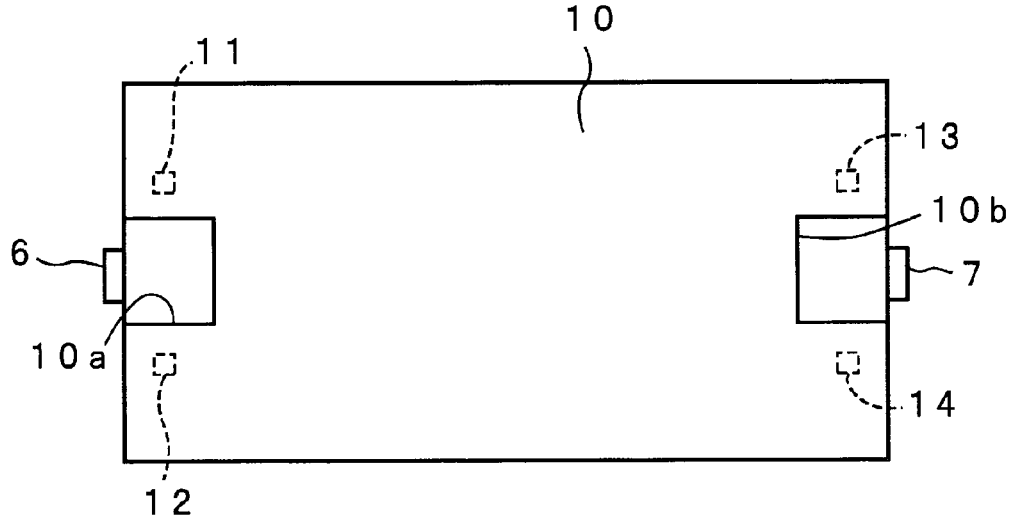

Specific preferred embodiments of the present invention will be described. FIGS. 1A and 1B are a perspective view and a plan view showing a band-pass filter 1 serving as a electronic chip component according to a first preferred embodiment of the present invention.

The band-pass filter 1 includes a substantially rectangular chip 2. The chip 2 includes a dielectric substrate, which includes an adequate dielectric material, such as fluoroplastics or ceramic.

Figure 2:
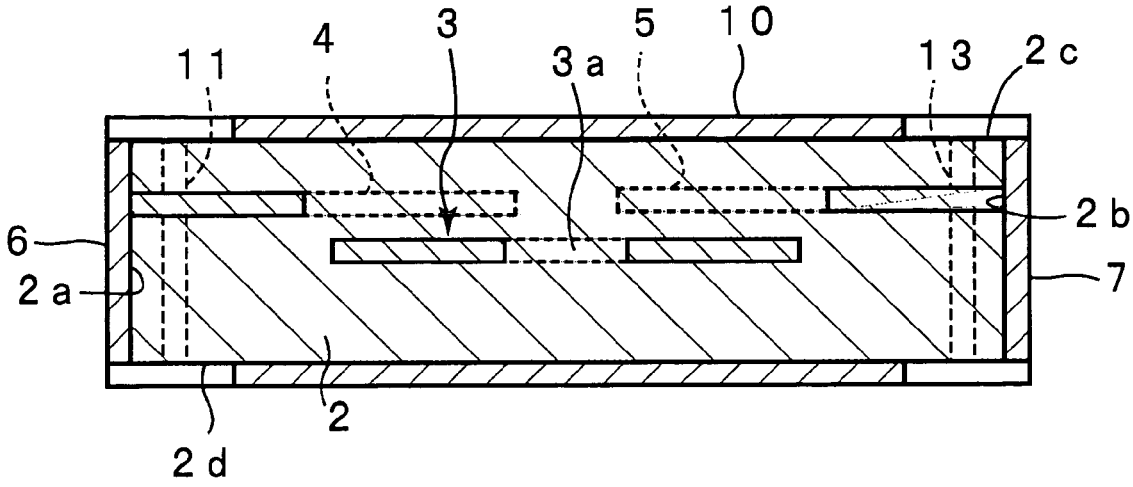
FIG. 2 is a cross-sectional view taken along the vertical plane of the dual-mode band-pass filter of the first preferred embodiment of the present invention.

As shown in the cross-sectional view in FIG. 2 taken along the vertical plane, a resonator electrode 3 is disposed at the approximate center in a height direction of the chip 2. Further, as shown in the schematic cross-sectional view in FIG. 3 taken along the horizontal plane, the resonator electrode 3 includes a metallic film having a through hole 3*a*. The resonator electrode 3 generates two resonance modes which are not degraded. The two resonance modes are coupled by the through hole 3*a*, such that a band-pass filter is obtained. Herein, the coupling degree of the two resonance modes is freely and significantly adjusted by adjusting the size of the through hole 3*a*. Such a band-pass filter is disclosed in the above-described Patent Document 1.

Figure 3:
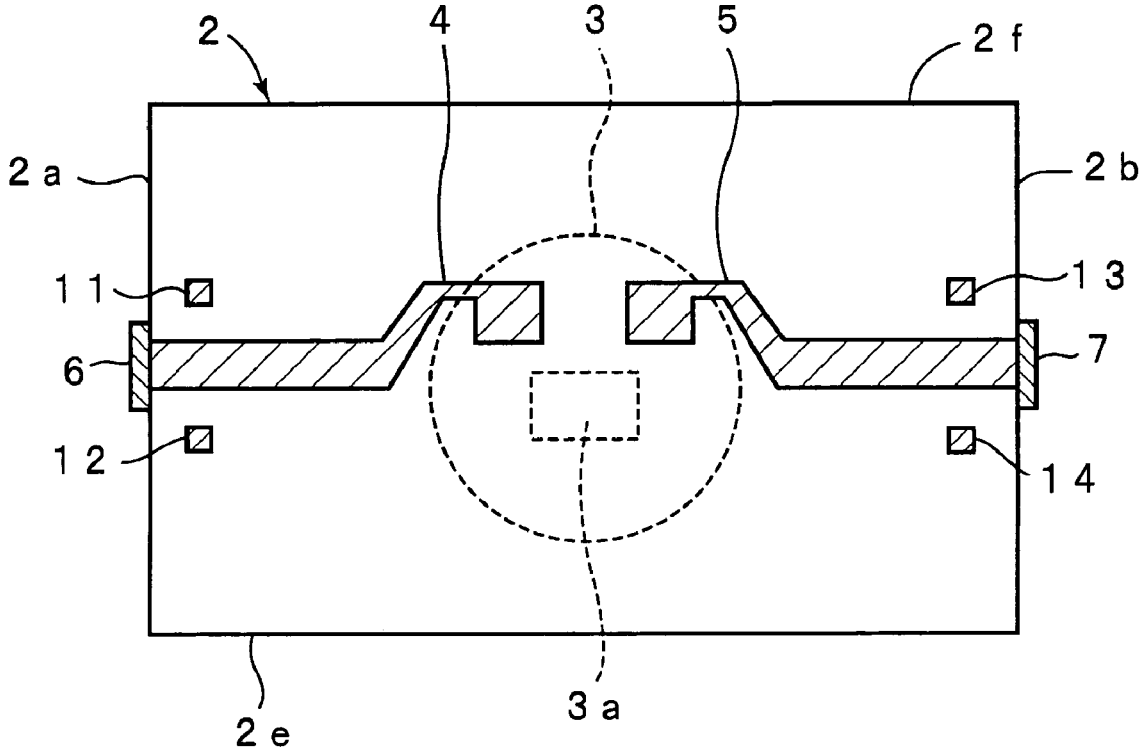
FIG. 3 is a schematic cross-sectional view taken along the horizontal plane for illustrating a resonator electrode disposed at the center in the height direction of the dual-mode band-pass filter of the first preferred embodiment of the present invention.

As shown in FIG. 3, input/output coupled electrodes 4 and 5 are disposed at a different height from the resonator electrode 3 so as to have lamination capacitance with the resonator electrode 3. The input/output coupled electrodes 4 and 5 are led to a pair of end surfaces 2*a* and 2*b* facing each other of the chip 2, respectively. The chip 2 includes the end surfaces 2*a* and 2*b*, an upper surface 2*c*, a lower surface 2*d*, and side surfaces 2*e* and 2*f*.

In this desired characteristic of the present preferred embodiment, the chip 2 is formed by laminating a plurality of dielectric layers. Each of the resonator electrode 3, the input/output coupled electrodes 4 and 5, and a first ground electrode 10 is provided on an upper or lower surface of one of the dielectric layers.

Alternatively, the input/output coupled electrodes 4 and 5 may be disposed at the same position as the resonator electrode 3 in a height direction, such that the input/output coupled electrodes 4 and 5 are separated from the resonator electrode 3.

An input electrode 6 and an output electrode 7 are disposed on the end surfaces 2*a* and 2*b*, respectively. The input and output electrodes 6 and 7 are electrically connected to the input/output coupled electrodes 4 and 5, respectively.

The input and output electrodes 6 and 7 extend in the vertical direction on the end surfaces 2*a* and 2*b*.

On the other hand, the first ground electrode 10 is disposed around the outer surface of the chip 2. The first ground electrode 10 covers the upper and lower surfaces 2*c* and 2*b* and the side surfaces 2*e* and 2*f* of the chip 2. Also, the first ground electrode 10 includes notches 10*a* and 10*b* at the upper surface 2*c* so as to prevent short circuit caused between the first ground electrode 10 and the input and output electrodes 6 and 7. Likewise, notches are provided in the first ground electrode 10 at the lower surface 2*d* of the chip 2.

The first ground electrode 10 covers the upper and lower surfaces 2*c* and 2*d* and the side surfaces 2*e* and 2*f* of the chip 2, except the notches 10*a* and 10*b* and the notches provided at the lower surface. In other words, the first ground electrode 10 has a tubular shape.

The band-pass filter 1 of this preferred embodiment includes a pair of second ground electrodes 11 and 12 are disposed on both sides of the input electrode 6, and a pair of second ground electrodes 13 and 14 are disposed on both sides of the output electrode 7. In this preferred embodiment, each of the second ground electrodes 11 to 14 includes a via-hole electrode for connecting upper and lower portions of the first ground electrode 10 on the upper and lower surfaces 2*c* and 2*d* of the chip 2. That is, the upper and lower portions of the first ground electrode 10 around the chip 2 are electrically connected by the second ground electrodes 11 to 14.

As described above, the via-hole electrodes in the chip 2 function as the second ground electrodes 11 to 14, which are positioned at the inner sides of the ends of the tubular first ground electrode 10 but at the closest positions to the input and output electrodes 6 and 7.

As described above, when a ground electrode has a tubular shape and defines a waveguide, resonance caused by the ground electrode, that is, basic resonance and a higher mode resonance thereof often generate undesired spurious signals. On the other hand, in the band-pass filter 1 of this preferred embodiment, the electric field is controlled by providing the second ground electrodes 11 to 14, which suppresses the undesired spurious signals. This will be described below based on a specific example.

In a first example, a chip component which is the same as the band-pass filter 1 except that the resonator electrode 3 and the input/output coupled electrodes 4 and 5 are not provided was prepared.

As the chip 2, a substantially rectangular dielectric substrate which includes a ceramic material primarily containing an oxide such as Ba, Al, and Si and which has a size of, for example, about 3.2×about 4.5×about 0.5 (thickness) mm was used. Also, the input and output electrodes 6 and 7 having a width of about 0.4 mm were provided at the approximate center of the end surfaces 2*a* and 2*b* of the chip 2 in the vertical direction, respectively. Further, the notches 10*a* and 10*b* on the upper surface and the notches on the lower surface were provided in a size of about 0.5 mm×about 0.5 mm in the width and longitudinal directions of the chip 2.

The second ground electrodes 11 to 14 were positioned about 0.35 mm inside the end surfaces 2*a* and 2*b* of the chip 2. Also, each of the second ground electrodes 11 to 14 was positioned at a distance of 33 mm in the width direction of the chip 2 from the center in the width direction of the chip 2, that is, the center in the width direction of the input electrode 6 or the output electrode 7. The distance × was varied in the range of about 0.4 mm, about 0.5 mm, about 0.55 mm, and about 0.6 mm, so as to prepare four types of chip components, and the frequency characteristics of each component were obtained. The result is shown in FIGS. 4 and 5.

For comparison, a chip component which is the same as the above-described chip component except that the second ground electrodes 11 to 14 are not provided was prepared.

Figure 4:
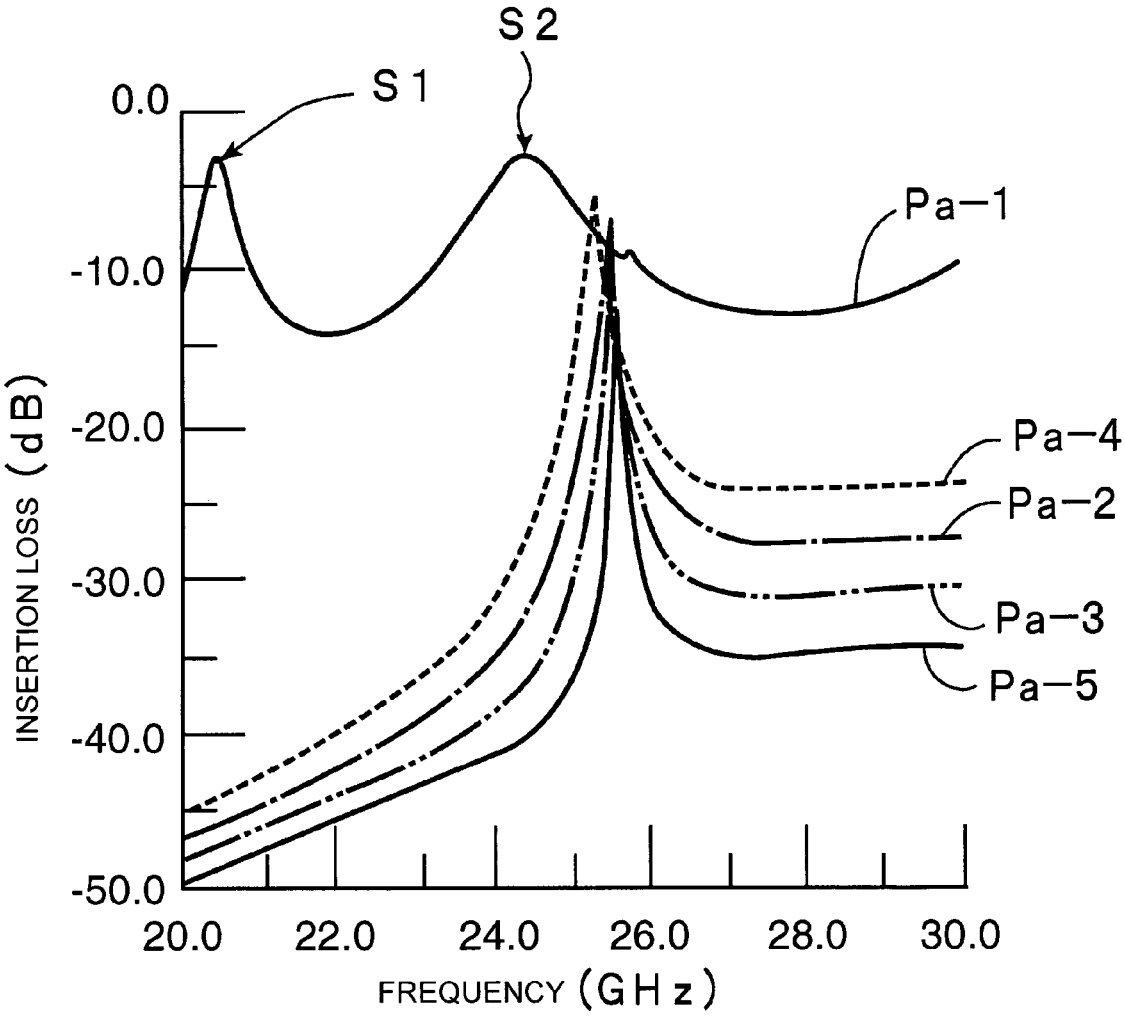
FIG. 4 shows the frequency characteristics of a chip component according to a comparative example and chip components according to the first preferred embodiment of the present invention.
Figure 5:
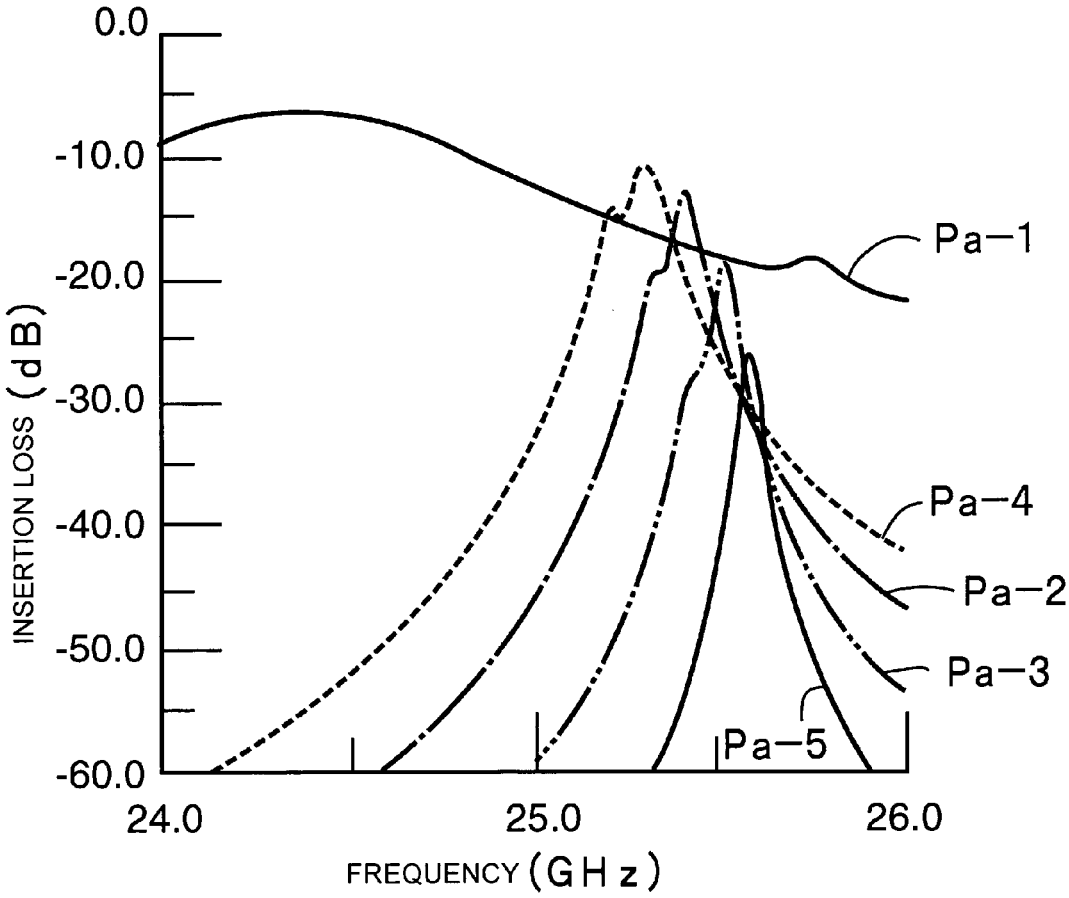
FIG. 5 is an enlarged view showing the critical part of the frequency characteristics shown in FIG. 4.

FIG. 4 shows the frequency characteristics of each of the prepared chip components, and FIG. 5 is an enlarged view showing the critical portion of the characteristics shown in FIG. 4. In order to find the frequency characteristics, the relative permittivity $\epsilon r$ was set to about 6.27 and $\tan\delta$ was set to about 0.001 in the chip 2, and each of the resonator electrode 3, input and output electrodes 6 and 7, first ground electrode 10, and second ground electrodes 11 to 14 were formed by using Cu.

A curve Pa-1 in FIGS. 4 and 5 indicates the frequency characteristics of the chip component prepared for comparison. Curves Pa-2 to Pa-5 indicate the frequency characteristics of resonance of the chip components in which the distance × is about 0.4 mm, about 0.5 mm, about 0.55 mm, or about 0.6 mm.

In the chip component of the comparative example, in which the second ground electrodes 11 to 14 are not provided, spurious signals S1 and S2 of attenuation of about 5 dB or less is generated at about 20.4 GHz and about 24.4 GHz. Also, shown in the figure, a frequency band in which the attenuation level is about 15 dB or less does not exist in the range of about 20 GHz to about 30 GHz.

On the other hand, as understood from the curves Pa-2 to Pa-5, spurious signals caused at about 20.4 GHz and about 24.4 GHz are suppressed in the chip components 1 including the second ground electrodes 11 to 14. Also, although spurious signal is generated at the vicinity of about 25 GHz, attenuation in the other region of the about 20 GHz to about 30 GHz band is reduced to about 20 dB or less.

Further, as is clear from the curves Pa-2 to Pa-5, as the distance × is reduced, that is, as the interval between the pair of second ground electrodes 11 and 12 or 13 and 14 decreases, the spurious frequency fs is increased and spurious signals are suppressed more effectively.

Figure 6A:
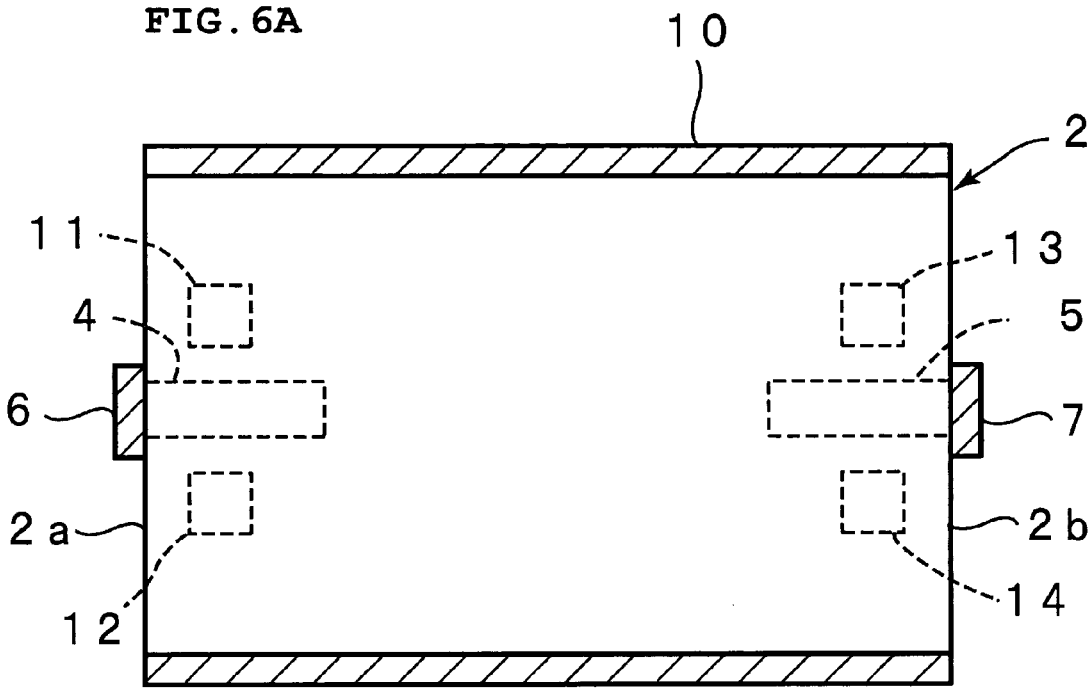
FIGS. 6A and 6B are a schematic plan view and a schematic side view illustrating the operation and effect of the dual-mode band-pass filter of the first preferred embodiment of the present invention.
Figure 6B:
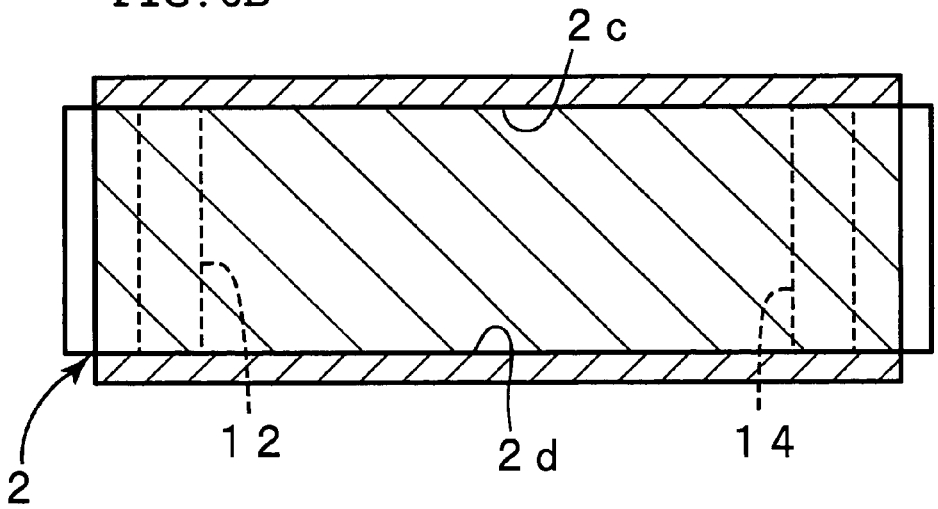

The input electrode 6 or the output electrode 7 and the second ground electrodes 11 to 14 may not be provided on the same plane or in a line. As schematically shown in FIGS. 6A and 6B, the input/output coupled electrodes 4 and 5 may be extended between the pair of second ground electrodes 11 and 12 and between 13 and 14, which connect the upper and lower portions of the first ground electrode 10. Accordingly, freedom of design is enhanced.

As described above, the chip components including the second ground electrodes 11 to 14 have a more enhanced transmission characteristic than that of the chip component of the comparative example which does not include the second ground electrodes 11 to 14. Then, according to the first preferred embodiment, the resonator electrode 3 prepared by forming a through hole 3*a* having a size of about 0.9 mm×about 0.8 mm in a circular metallic film having a radius of about 1.1 mm and the input/output coupled electrodes 4 and 5 were further provided in the chip component including the second ground electrodes 11 to 14, so as to produce the band-pass filter 1 according to the first preferred embodiment.

Figure 7:
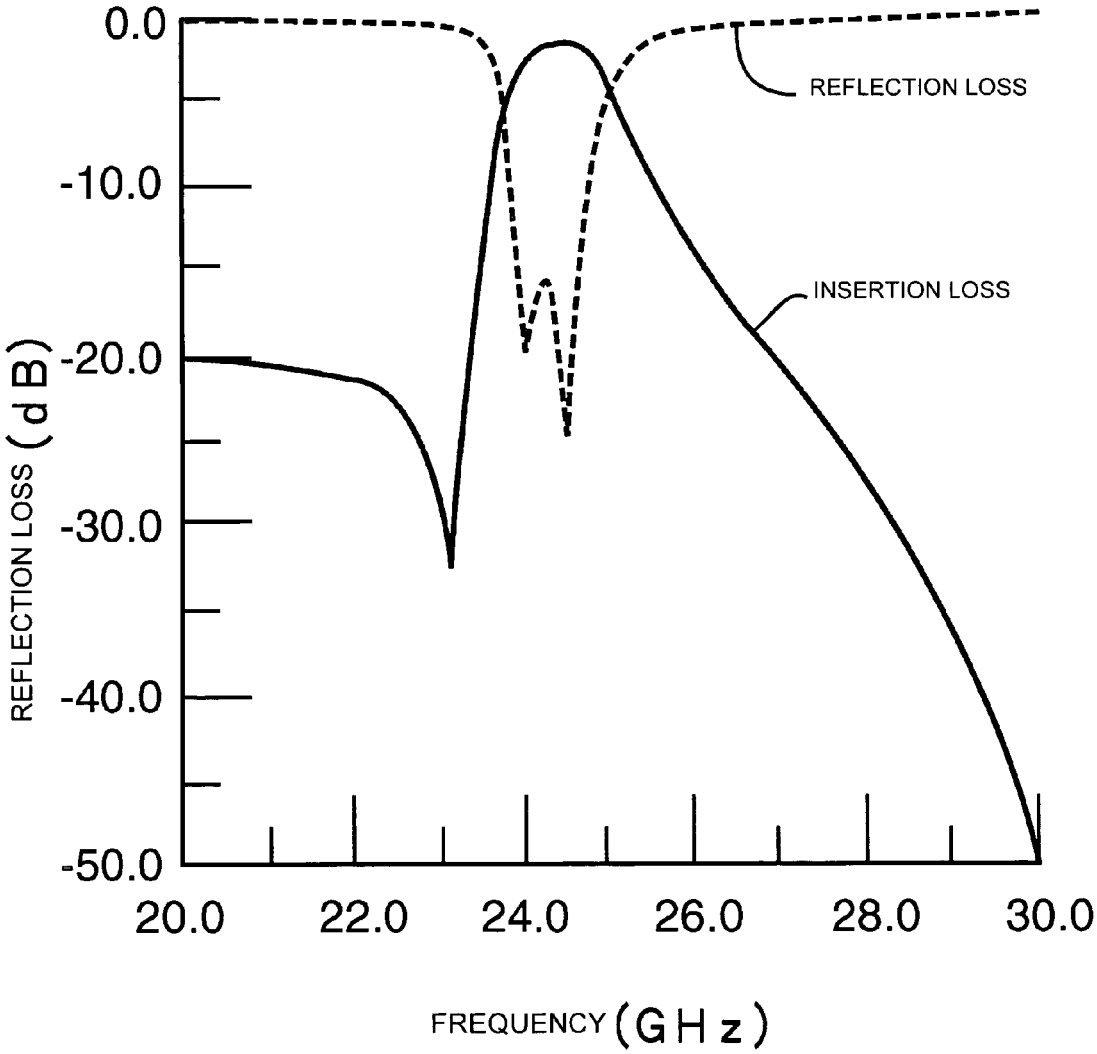
FIG. 7 shows the frequency characteristic of the dual-mode band-pass filter according to the first preferred embodiment of the present invention.

FIG. 7 shows an example of the frequency characteristic of the dual-mode band-pass filter 1 formed in the above-described manner. As can be seen, spurious signals do not appear in FIG. 7. In the dual-mode band-pass filter according to this preferred embodiment, spurious signals caused by the shape of filter, that is, spurious signals caused by the ground electrode in a shape of a waveguide, are suppressed, and the band-pass filter is obtained.

Figure 8A:
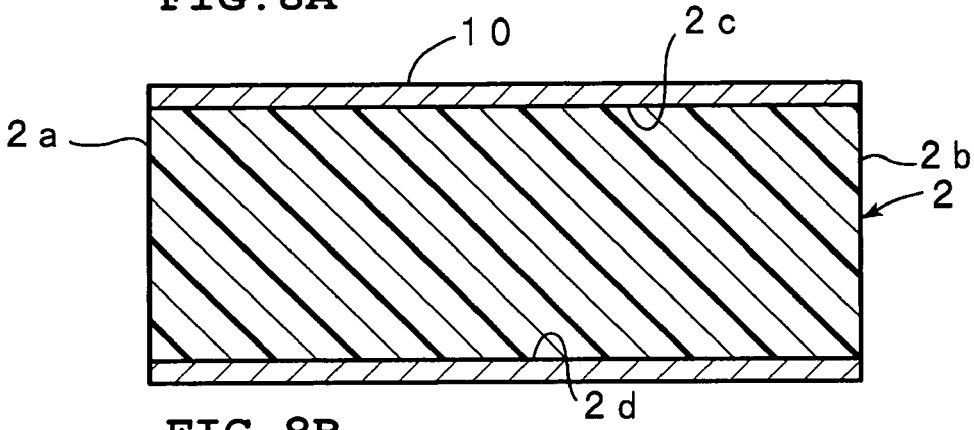
FIGS. 8A to 8D are schematic cross-sectional views showing examples of arrangement of a first ground electrode in the dual-mode band-pass filter according to the first preferred embodiment of the present invention and modifications thereof.
Figure 8B:
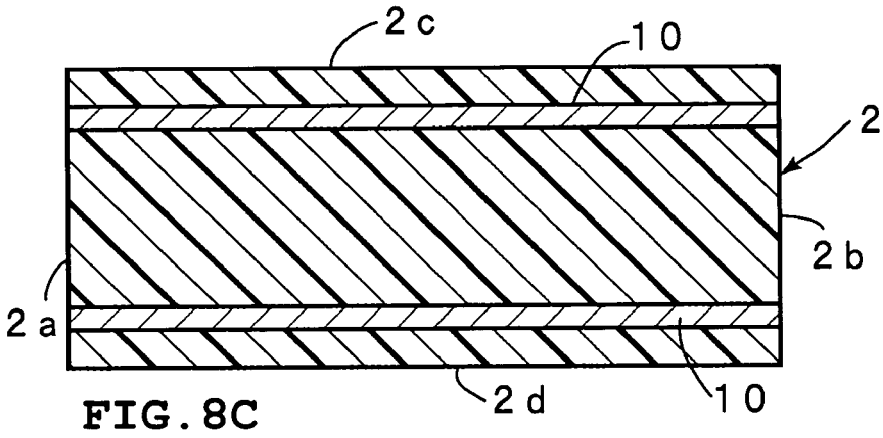
Figure 8C:
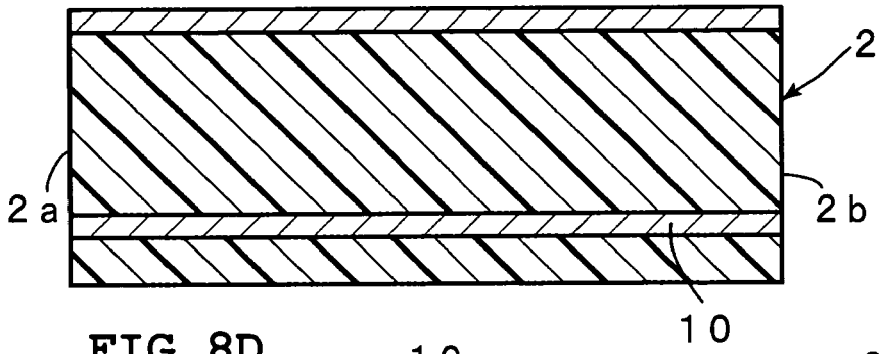
Figure 8D:
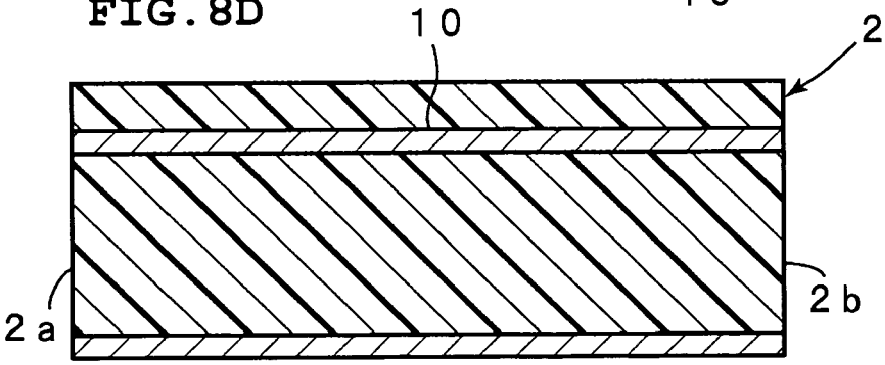

FIGS. 8A to 8D are schematic cross-sectional views showing modifications of the band-pass filter 1 of this preferred embodiment. In the band-pass filter 1 shown in FIGS. 1A and 1B, the first ground electrode 10 covers the upper and lower surfaces of the chip 2. That is, as shown in FIG. 8A, the first ground electrode 10 is disposed on the upper and lower surfaces 2*c* and 2*d* of the chip 2. Alternatively, as shown in FIGS. 8B to 8D, a portion of the first ground electrode 10 which is substantially parallel to the upper or lower surface of the chip 2 may be embedded in the chip 2. In FIG. 8B, both upper and lower portions of the first ground electrode 10 which are substantially parallel to the upper and lower surfaces 2*c* and 2*d* are embedded in the chip 2. In FIG. 8C, the portion of the first ground electrode 10 that is substantially parallel to the lower surface 2*d* is embedded in the chip 2, and the portion that is substantially parallel to the upper surface 2*c* is disposed on the upper surface 2*c*. In FIG. 8D, the portion of the first ground electrode that is substantially parallel to the upper surface 2*c* is embedded in the chip 2, and the portion that is substantially parallel to the lower surface 2*d* is disposed on the lower surface 2 *d*.

Likewise, the portions of the first ground electrode 10 that are substantially parallel to the side surfaces 2*e* and 2*f* (FIG. 1A) may be embedded in the chip 2.

In the electronic chip component according to preferred embodiments of the present invention, spurious signals based on resonance caused by the tubular shape of the first ground electrode are suppressed. Therefore, the portions of the first ground electrode 10 that are substantially parallel to the upper and lower surfaces 2*c* and 2*d* and the side surfaces 2*e* and 2*f* of the chip 2 disposed either in the chip 2 or on the surface of the chip 2, as long as the first ground electrode 10 is tubular shaped. Also, as shown in FIGS. 8A to 8D, by disposing the first ground electrode above and below the resonator electrode (not shown) with dielectric substrate layers therebetween so as to form a tri-plate structure, and by providing the second ground electrodes according to the present invention, the advantages of the present invention are obtained. That is, the portions of the first ground electrode 10 on the side surfaces of the chip 2 are not always required.

Figure 9:
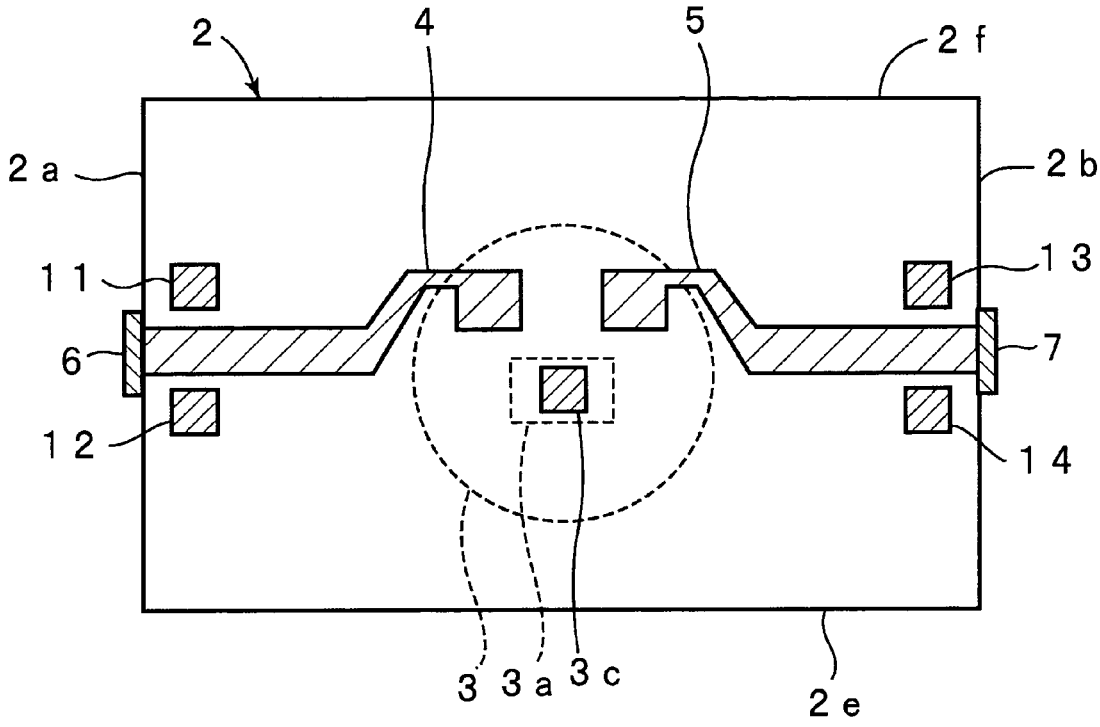
FIG. 9 is a schematic cross-sectional view showing a resonator electrode and a via-hole electrode serving as a third ground electrode in a dual-mode band-pass filter according to a second preferred embodiment of the present invention.

FIG. 9 is a schematic cross-sectional view illustrating the shape of a resonator electrode in a band-pass filter serving as a electronic chip component of a second preferred embodiment of the present invention, and the figure corresponds to FIG. 3 illustrating the first preferred embodiment. As understood by comparing FIGS. 3 and 9, in the band-pass filter of the second preferred embodiment, a via-hole electrode 3*c* defining a third ground electrode is provided in the through hole 3*a* of the resonator electrode 3. Except for the via-hole electrode 3*c* being provided, the band-pass filter of the second preferred embodiment is the same as the band-pass filter 1 of the first preferred embodiment. Therefore, the description of the portions other than the via-hole electrode 3*c* is omitted.

The upper and lower ends of the via-hole electrode 3*c* are connected to the portions of the first ground electrode 10 on the upper and lower surfaces of the chip 2 shown in FIG. 1, respectively. That is, similar to the second ground electrodes 11 to 14, the via-hole electrode 3*c* short-circuits the portions of the first ground electrode 10 on the upper and lower surfaces of the chip 2.

In this preferred embodiment, by providing the via-hole electrode 3*c*, undesired spurious signals caused by the shape of the first ground electrode 10 are suppressed more effectively. This will be described with reference to FIGS. 10 and 11.

Figure 10:
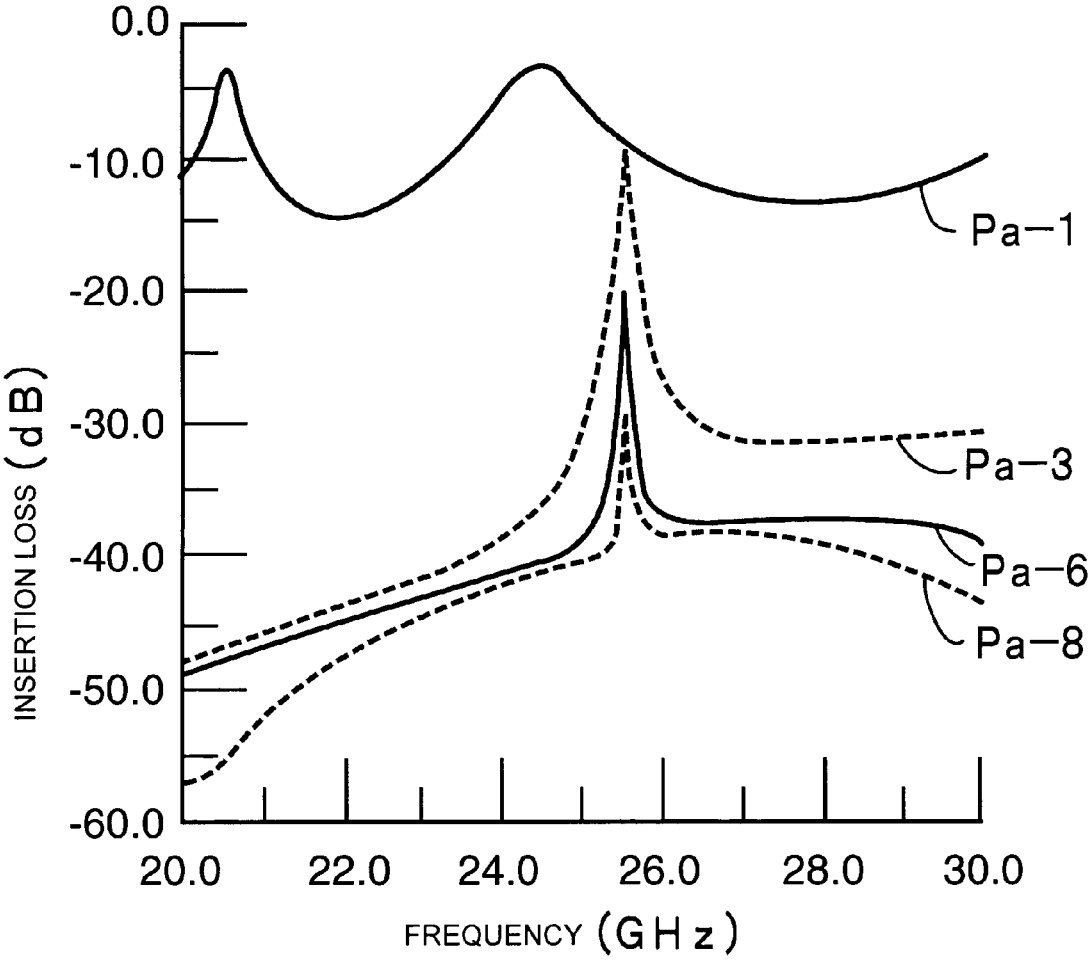
FIG. 10 shows the frequency characteristics of chip components according to a comparative example and chip components according to the first and second preferred embodiments of the present invention.
Figure 11:
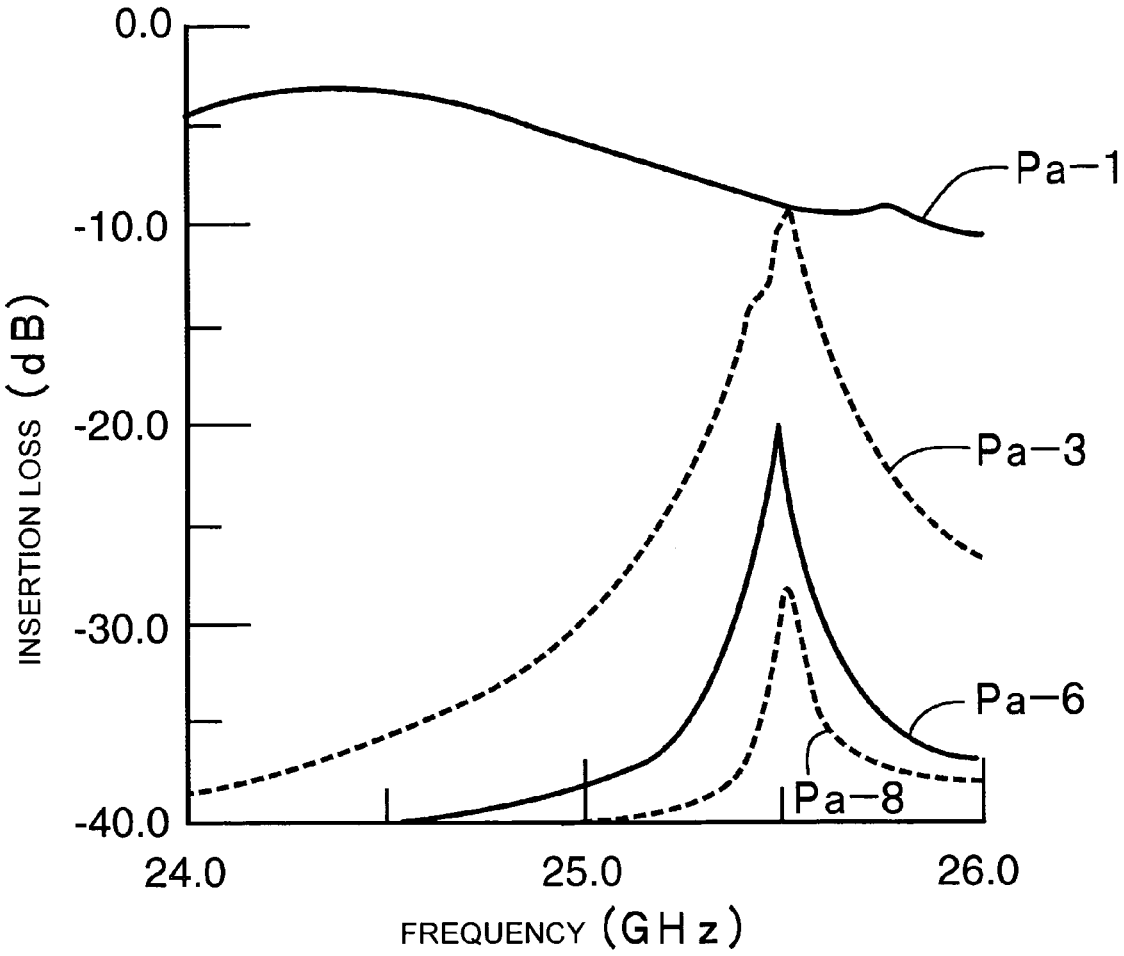
FIG. 11 is an enlarged view showing the critical part of the frequency characteristics shown in FIG. 10.

In order to obtain the characteristic curves shown in FIGS. 10 and 11, a chip component which does not include a resonator electrode and input/output coupled electrodes was prepared as in the first example of the first preferred embodiment, and it was examined whether different frequency characteristics are obtained when the via-hole electrode 3*c* is provided. That is, the chip components having the characteristic curves Pa-1 and Pa-3 shown in FIG. 4 were prepared for comparison. On the other hand, the via-hole electrode 3*c* for connecting the upper and lower portions of the first ground electrode 10 was provided in the chip component having the characteristic Pa-3 so as to obtain another chip component. The via-hole electrode 3*c* was formed so as to have a substantially rectangular cross-section of about 0.2 mm×about 0.2 mm.

FIG. 10 shows curves Pa-1 and Pa-3 indicating the characteristics of the chip components prepared for comparison and the frequency characteristic of the chip component including the via-hole electrode 3*c*.

FIG. 11 is an enlarged view showing the critical portion of the characteristic curves shown in FIG. 10.

As is clear from FIGS. 10 and 11, in the chip component including the via-hole electrode 3*c*, spurious signals caused by the shape of the first ground electrode are effectively suppressed as in the chip component having the characteristic indicated by the curve Pa-3. Therefore, by providing the resonator electrode 3 and the input/output coupled electrodes 4 and 5 in the chip component having the characteristic indicated by the curve Pa-6, a band-pass filter having a favorable transmission characteristic in which spurious signals caused by the shape of the first ground electrode is obtained in accordance with the second preferred embodiment of the present invention.

Figure 12:
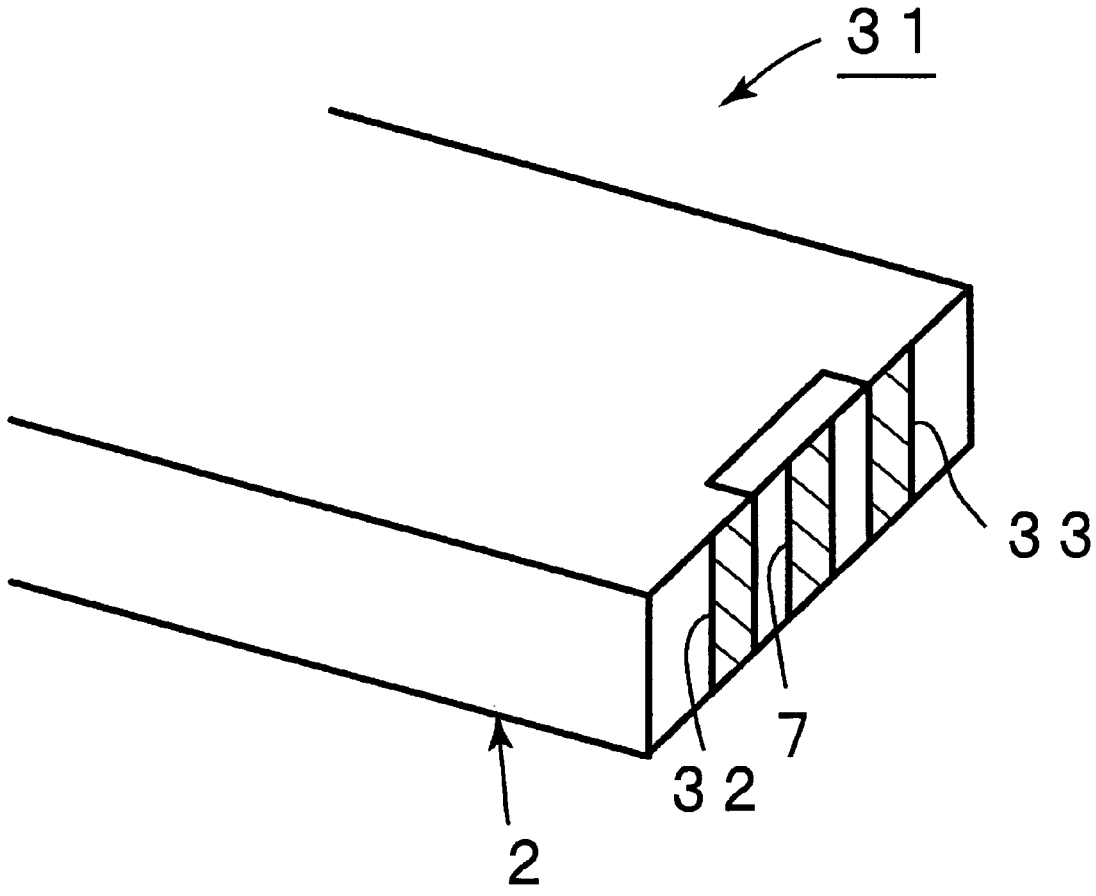
FIG. 12 is a partial perspective view showing a dual-mode band-pass filter according to a third preferred embodiment of the present invention.

FIG. 12 is a partial perspective view showing the critical portion of a band-pass filter 31 defining a electronic chip component of a third preferred embodiment of the present invention. In the first preferred embodiment, the second ground electrodes 11 to 14 are providing using via-hole electrodes and are disposed in the chip 2. In other words, the second ground electrodes 11 to 14 are disposed in the inner sides of the ends of the tubular first ground electrode 10. On the other hand, in the band-pass filter 31 of the third preferred embodiment, second ground electrodes 32 and 33 on both sides of the output electrode 7 extend to the end surface 2*b*. In other words, the second ground electrodes 32 and 33 extend to the end portion of the tubular first ground electrode 10. Although only the second ground electrodes 32 and 33 on both sides of the output electrode 7 are shown in FIG. 12, second ground electrodes are also provided on both sides of the input electrode 6.

Figure 13:
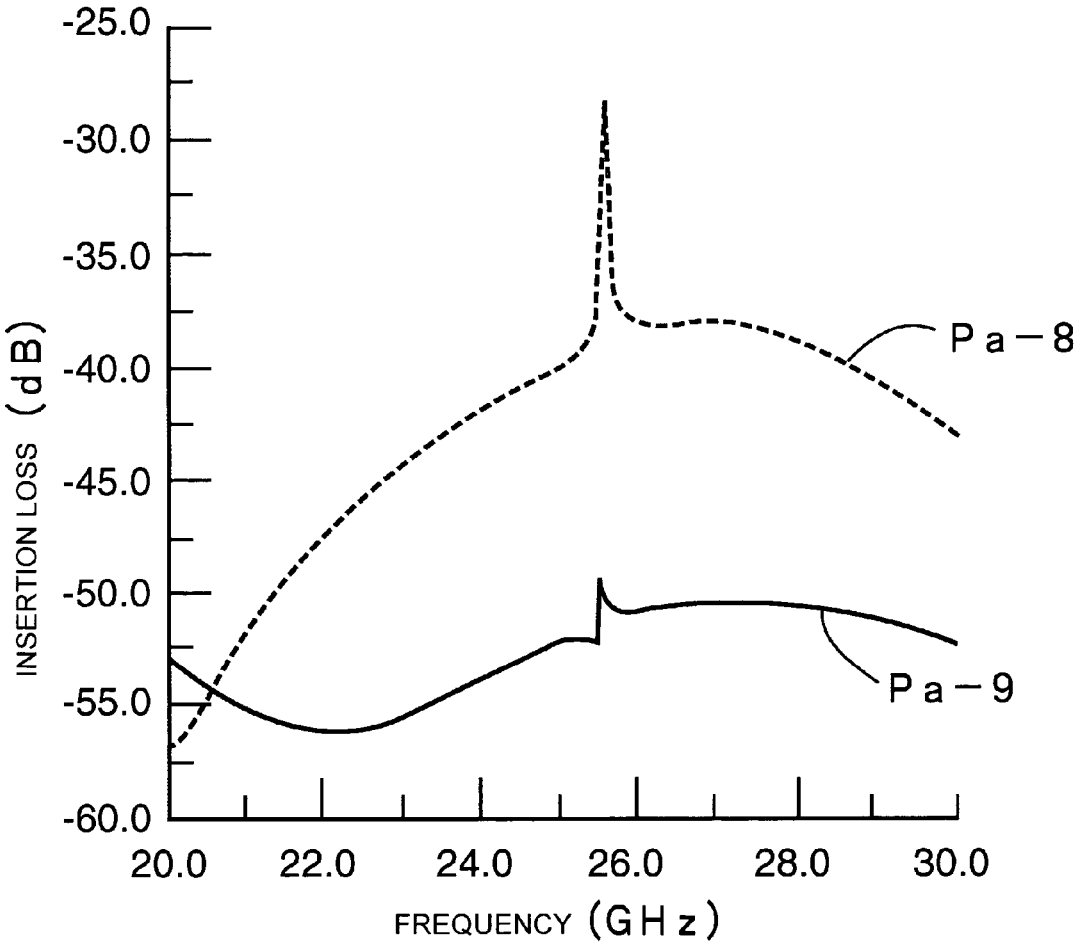
FIG. 13 shows the frequency characteristics of a chip component according to the third preferred embodiment of the present invention and a chip component according to a comparative example.

In accordance with the third preferred embodiment, a chip component including the second ground electrodes was prepared so as to determine the frequency characteristics thereof. As the chip component, a chip component which is the same as the one used in the first example of the first preferred embodiment was prepared. However, the second ground electrodes 11 to 14 were provided at the end surfaces 2*a* and 2*b* of the chip 2 as shown in FIG. 12. The curve Pa-9 in FIG. 13 shows the characteristic of the chip component prepared in this way. The curve Pa-8 in FIG. 13 is the same as that shown in FIGS. 10 and 11.

As is clear from FIG. 13, when the second ground electrodes are provided at the end surfaces 2*a* and 2*b*, too, as in the third preferred embodiment, spurious signals caused by the shape of the first ground electrode are effectively reduced according to the present invention.

Figure 14:
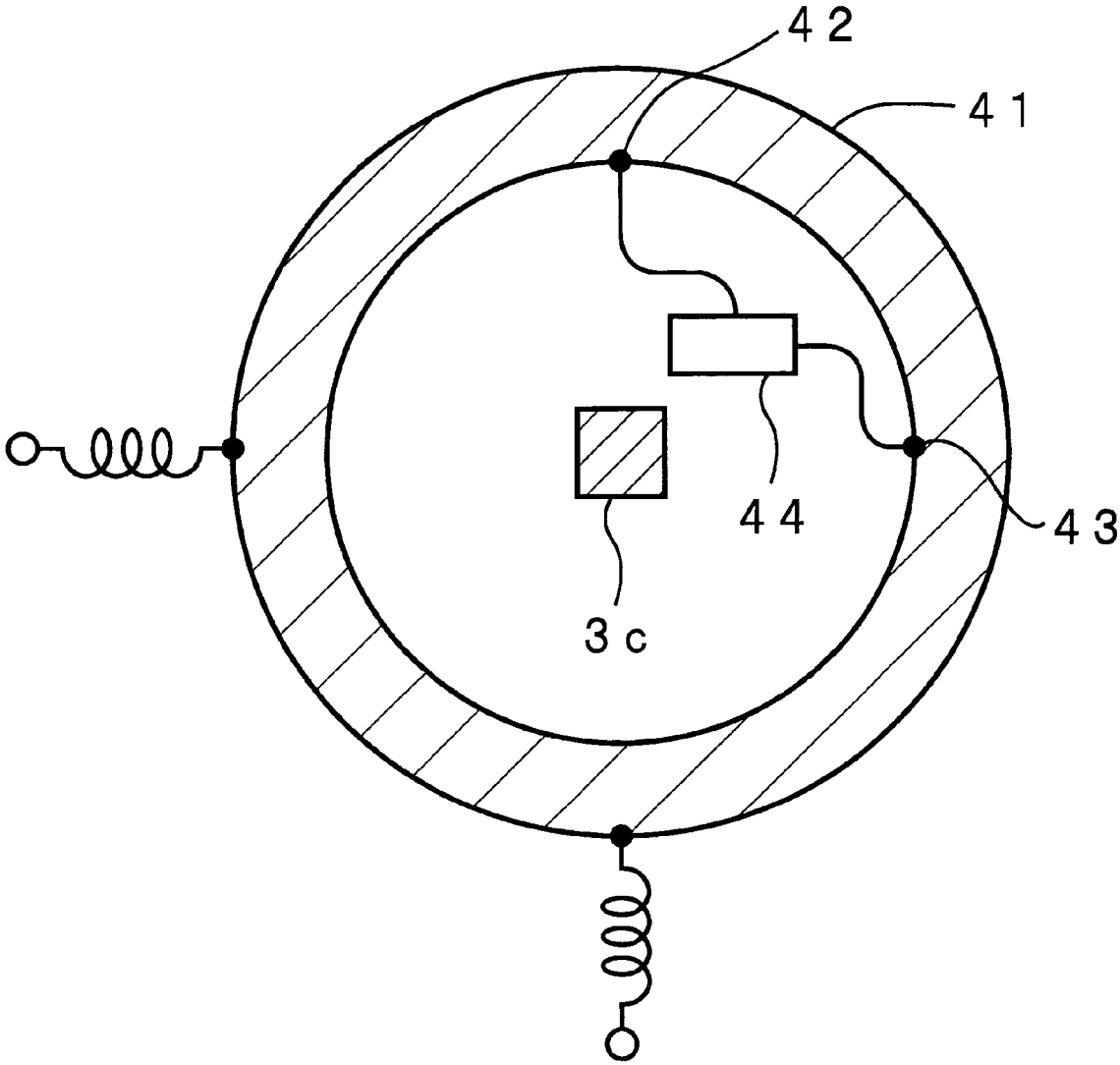
FIG. 14 is a schematic plan view illustrating a dual-mode band-pass filter including a resonator electrode ring, which is another example of the electronic chip component to which the present invention is applied.
Figure 15A:
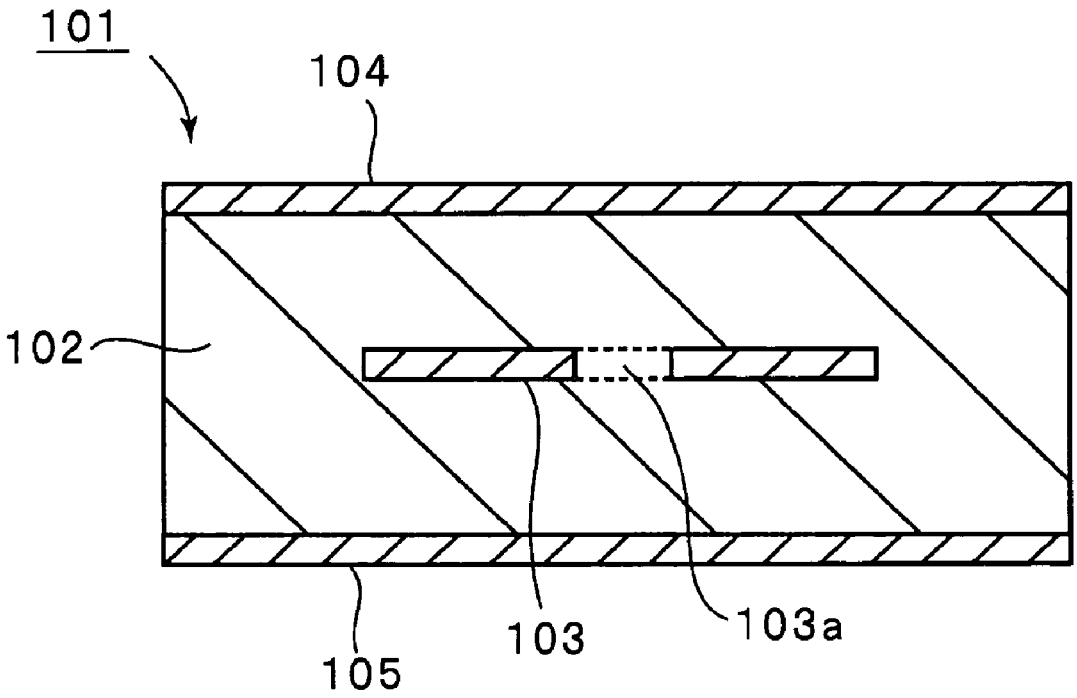
FIG.15A PRIOR ART
FIGS. 15A and 15B are a cross-sectional view and a schematic plan view showing an example of a known dual-mode band-pass filter.
Figure 15B:
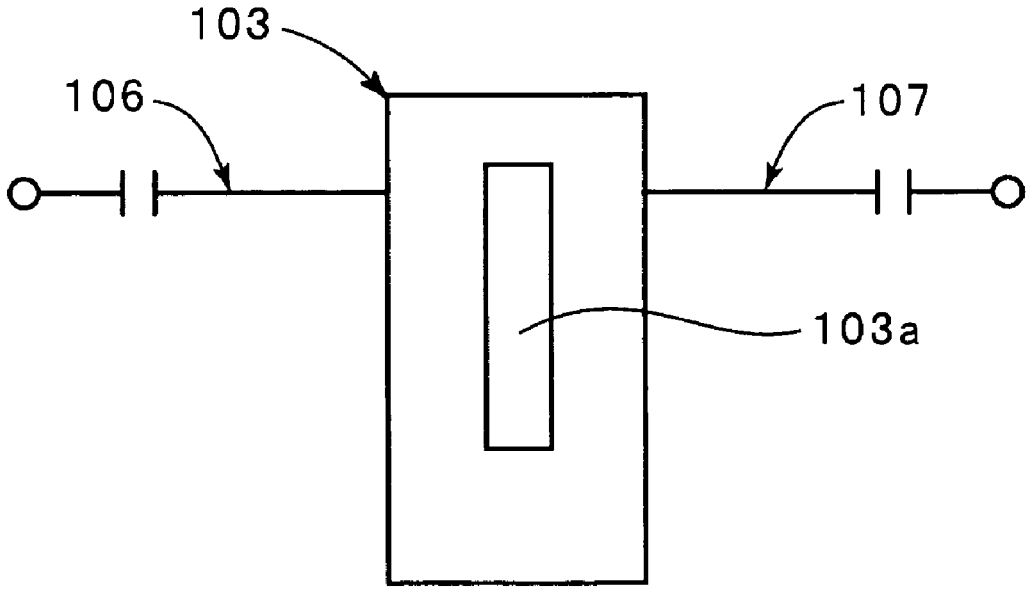
FIG.15B PRIOR ART

In the electronic chip component of various preferred embodiments of the present invention, the resonance electrode is provided in the chip. As long as a tubular ground electrode is provided around the chip so as to enclose the resonator electrode, the shape of the resonator electrode and the ground electrode is not limited. Therefore, the resonator electrode is not limited to a resonator electrode for coupling two resonance modes which are not degraded so as to obtain the band-pass filter. Alternatively, a resonator electrode ring 41 shown in FIG. 14 may be used. The resonator electrode ring 41 preferably has a ring-shape. By controlling the positions of junctions 42 and 43, the band-pass filter is obtained. A feedback circuit 44 is connected to the junctions 42 and 43.

The present invention can be applied not only to dual-mode band-pass filters, but also to electronic chip components including various types of resonator electrodes.

Figure 16:
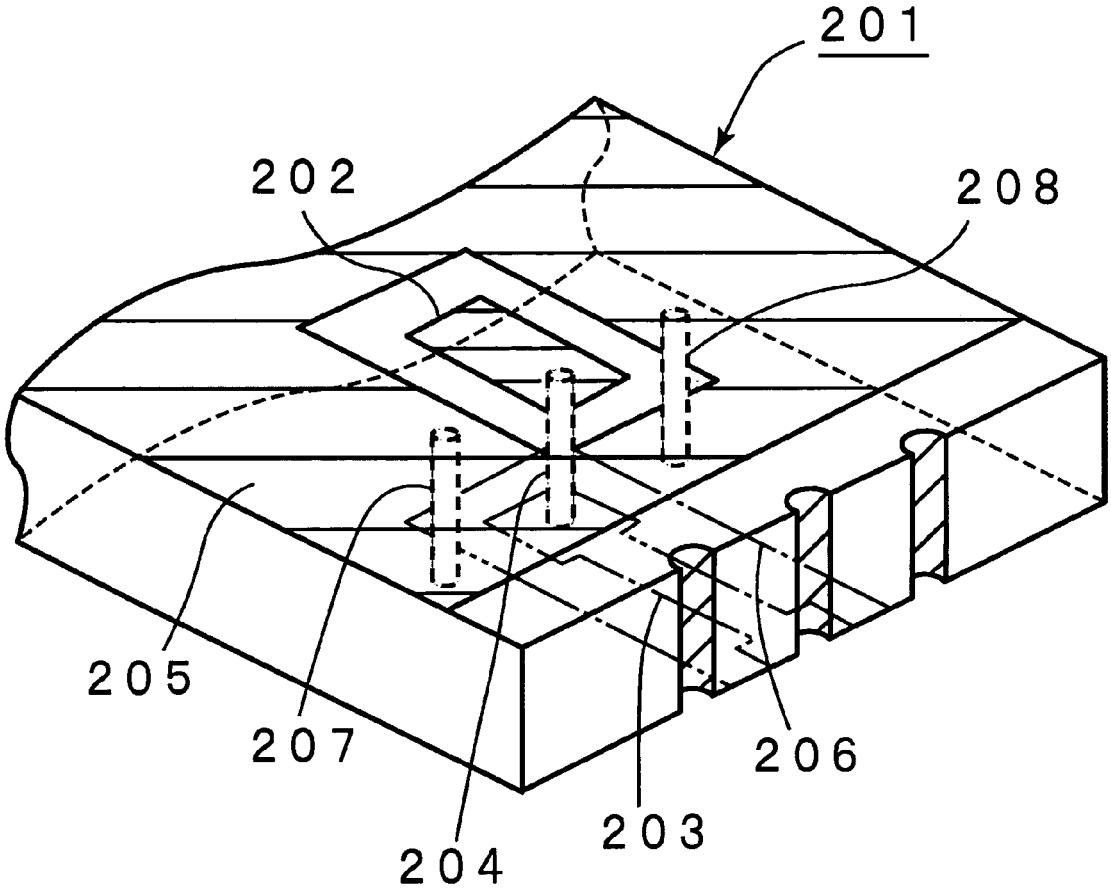
FIG. 16 PRIOR ART
FIG. 16 is a partial perspective view illustrating the configuration of electrodes in a known package substrate.

In Japanese Unexamined Patent Application Publication No. 2000-208670, a ground electrode having a configuration similar to that of the present invention is disclosed. However, this configuration is not directly related to the resonator and the band-pass filter, and this Patent Document simply discloses a package substrate including distributed-constant lines. That is, in this Patent Document, as shown in the perspective view in FIG. 16, first and second distributed-constant lines 202 and 203 are provided on the upper and lower surfaces of a package substrate 201, and the first and second distributed-constant lines 202 and 203 are electrically connected by a via-hole electrode 204. Further, via-hole electrodes 207 and 208, which connect ground electrodes 205 and 206 provided on the upper and lower surfaces of the package substrate 201, are disposed on both sides of the via-hole electrode 204. Herein, by disposing the via-hole electrodes 207 and 208 for connecting the upper and lower ground electrodes on both sides of the via-hole electrode 204, stray capacitance generated at end-surface electrodes are canceled, such that mismatch in signal lines is suppressed.

In the above-described configuration, the via-hole electrodes 207 and 208 for connecting the ground electrodes are simply provided on both sides of the via-hole electrode 204 such that the via-hole electrode 204 for connecting the upper and lower distributed-constant lines does not function as an inductor. Also, the via-hole electrode 204 is operated as a distributed-constant line having a predetermined characteristic impedance.

The present invention is not limited to the above-described preferred embodiments, but can be modified in the scope of the attached claims. Further, the technologies disclosed in the above-described preferred embodiments can be used in combination, as desired.

What is claimed is:

1. An electronic chip component comprising:

a chip including upper and lower surfaces, a pair of side surfaces, and first and second end surfaces facing each other;

a resonator electrode provided in the chip;

input and output electrodes extending in a vertical direction of the chip, which are coupled or connected to the resonator electrode; and a first ground electrode disposed around the chip, the first ground electrode having a tubular shape so as to enclose the resonator electrode; wherein the input and output electrodes are disposed at end portions or inner sides of the tubular first ground electrode, such that the input and output electrodes are not electrically connected to the first ground electrode;

the electronic chip component further includes at least a pair of second ground electrodes which are disposed on both sides of at least one of the input electrode and the output electrode and which are electrically connected to the first ground electrode;

the resonator electrode is arranged so as to generate a plurality of resonance modes which are not degraded and the resonator electrode includes a through hole for coupling the plurality of resonance modes, whereby a band-pass filter is provided; and the electronic chip component further includes a third ground electrode which extends in the through hole so as not to be in contact with the resonator electrode and which is electrically connected to the first ground electrode.

2. A electronic chip component according to claim 1, wherein the chip is substantially rectangular, the input and output electrodes are disposed on the first and second end surfaces facing each other, respectively, and the first ground electrode includes surfaces that are substantially parallel to the upper and lower surfaces and the pair of side surfaces of the chip so as to define a tubular shape.

3. A electronic chip component according to claim 2, wherein at least one of the surfaces of the first ground electrode that are substantially parallel to the upper and lower surfaces and the pair of side surfaces of the chip is embedded in the chip.

4. A electronic chip component according to claim 2, wherein the first ground electrode surrounds the upper and lower surfaces and the pair of side surfaces of the chip.

5. A electronic chip component according to claim 1, wherein the input and output electrodes extend in the vertical direction on the first and second end surfaces, respectively.

6. A electronic chip component according to claim 2, wherein the second ground electrodes extend in vertical direction at the end surfaces of the chip.

7. An electronic chip component according to claim 2, wherein the second grounded electrode at at least one of the upper surface and lower surface of the chip.

8. A electronic chip component according to claim 1, wherein the resonator electrode comprises a ring-shaped resonator.

* * * * *